US010068236B2

(12) United States Patent
Kumar et al.

(10) Patent No.: US 10,068,236 B2
(45) Date of Patent: Sep. 4, 2018

(54) METHODS AND ARRANGEMENTS FOR THIRD PARTY CHARGING AUTHORIZATION FOR MOBILE SERVICE PROVIDERS

(75) Inventors: Apurva Kumar, Uttar Pradesh (IN); Aamer Iqbal Rana, Dubai (AE)

(73) Assignee: International Business Machines Corporation, Armonk, NY (US)

( * ) Notice: Subject to any disclaimer, the term of this patent is extended or adjusted under 35 U.S.C. 154(b) by 332 days.

(21) Appl. No.: 13/095,251

(22) Filed: Apr. 27, 2011

(65) Prior Publication Data

US 2012/0278214 A1 Nov. 1, 2012

(51) Int. Cl.
*G07F 19/00* (2006.01)
*G06Q 30/00* (2012.01)

(52) U.S. Cl.
CPC ..... *G06Q 30/00* (2013.01)

(58) Field of Classification Search
CPC . H04L 5/00; G06F 3/00; G06Q 20/00; H04W 48/16
USPC ..... 705/26, 37, 75, 34
See application file for complete search history.

(56) References Cited

U.S. PATENT DOCUMENTS 7,376,840 B2 5/2008 McCann et al.
2007/0100651 A1* 5/2007 Ramer ..... G06Q 20/16 705/37
2008/0062840 A1 3/2008 Baek et al.
2009/0157792 A1 6/2009 Fiatal
2010/0153227 A1* 6/2010 Medvinsky ..... G06Q 20/123 705/26.1
2011/0022522 A1* 1/2011 Sege ..... G06O 20/32 705/75

FOREIGN PATENT DOCUMENTS

WO 2008041942 4/2008

OTHER PUBLICATIONS

Lee, Chung-Wei, "Mobile Commerce Security and Payment Methods", Mobile Commerce Security and Payment Methods, Copyright 2005, 18 pages, Idea Group, Inc., Hershey, Pennsylvania, USA, available at http://64.225.152.8/downloads/excerpts/01%20Hu.pdf as of Jan. 27, 2011.

Cai, Yigang, et al., "Authorization mechanisms for mobile commerce implementations in enhanced prepaid solutions", Bell Labs Technical Journal, Winter 2004, pp. 121-131, vol. 8, Issue 4, Wiley Online Library, abstract only, available at http://onlinelibrary.wiley.com/doi/10.1002/bltj.10091/abstract as of Jan. 27, 2011.

* cited by examiner

*Primary Examiner* — Rokib Masud
(74) *Attorney, Agent, or Firm* — Ference & Associates LLC

(57) ABSTRACT

Methods and arrangements for handling web-based purchase requests. A customer request for content of a third party content provider is received at a charging service provider. An authorization code on behalf of the content provider is generated and returned to the customer via a channel other than a channel which links the customer with the third party content provider. The authorization code is accepted from the third party content provider as received by the third party content provider from the customer, the authorization code is verified, and charging for the requested content is executed.

22 Claims, 13 Drawing Sheets

202

| | | *Preferred Ordering Channel* | | | *Preferred Delivery Method* | | | *Management Channel* | | |
|---|---|---|---|---|---|---|---|---|---|---|
| **Content Type** | **Transaction Type** | **Web** | **WAP** | **SMS** | **SMS** | **MMS** | **WAP Push** | **Web** | **WAP** | **SMS** |
| Rich Content | Event | Y | Y | | | Y | Y | | | |
| Text | Event | | | Y | Y | | | | | |
| Rich Content | Subscription | Y | Y | Y | | Y | Y | Y | Y | Y |
| Text | Subscription | Y | Y | Y | Y | | | Y | Y | Y |
| RBT | Subscription | Y | Y | Y | | | | Y | Y | Y |

FIG. 2

METHODS AND ARRANGEMENTS FOR THIRD PARTY CHARGING AUTHORIZATION FOR MOBILE SERVICE PROVIDERS

BACKGROUND

Mobile service providers are moving away from access-based business models due to diminishing margins in traditional network based services. Instead, there now exist efforts to target the millions of subscribers on their network with rich content and multimedia services. Mobile content is any type of text or media content (news, weather forecasts, ring tones, wallpapers, games, applications, etc.) that can be viewed or used on a mobile phone. Since the service providers already have a billing relationship with these customers, it is easy to offer them content services that can be billed through an existing pay channel. Direct mobile billing is a desirable option for purchasing mobile content when compared to payment solutions that require the sharing of private information (e.g., credit card number, account number, authentication information with online payment instruments, etc.).

Generally, mobile service providers rely on content partners (CP) to provide content. There are two models typically used by operators for providing content to their customers, on-deck and off-deck. In the on-deck model, content may be provided by a CP, but sold under the branding of the service provider. In the off-deck model, content is sold directly by the CP to the service provider's customers. Traditionally, the on-deck model has been the preferred model for providers.

However, it has been noted that service providers that have opened up to the off-deck model have seen their content business growing many-fold due to the sheer volume, regional coverage and creativity of off-deck content partners; the on-deck model often cannot match these advantages. As such, in the off-deck model, services are provided directly by the CP to the subscriber and the corresponding charges are communicated to the service provider. Implicit in this mode of operation is the assumption that the service provider has complete trust on charging claims made by its content providers.

Understandably, such trust is difficult to establish with a large number of content partners and this lack of trust is a major hindrance in acceptance of the off-deck model by service providers. The concerns associated with this model in the current form are related to the following actions that a fraudulent CP may be able to perform unchecked, merely by way of example: charging a customer for a content he/she did not purchase or was tricked into purchasing; charging an amount more than the price displayed at the time of purchase; starting a subscription against the customer's wishes when the customer only made a one-time purchase request; renewing a subscription even though the subscriber has given instructions to stop the service; and providing a service which is inconsistent with a displayed specification.

This, in turn, leads to problems difficulties at the service provider end, including (by way of example): customer dissatisfaction, resulting in a blow to the provider's reputation and an attendant decline in revenue; increased help desk calls to handle resulting complaints, thus adding to the cost of supporting the content business; revenue leakage due to revenue share for unauthorized transactions going to the CP; and increased costs of partner revenue settlement and partner management, thereby limiting the capability to partner with a large number of content partners.

BRIEF SUMMARY

In summary, one aspect of the invention provides a method comprising: receiving, at a charging service provider, notice of a customer request for content of a third party content provider; generating an authorization code on behalf of the content provider and returning the authorization code to the customer via a channel other than a channel which links the customer with the third party content provider; accepting the authorization code from the third party content provider as received by the third party content provider from the customer; verifying the authorization code; and executing charging for the requested content.

Another aspect of the invention provides an apparatus comprising: at least one processor; and a computer readable storage medium having computer readable program code embodied therewith and executable by the at least one processor, the computer readable program code comprising: computer readable program code configured to receive notice of a customer request for content of a third party content provider; computer readable program code configured to generate an authorization code on behalf of the content provider and returning the authorization code to the customer via a channel other than a channel which links the customer with the third party content provider; computer readable program code configured to accept the authorization code from the third party content provider as received by the third party content provider from the customer; computer readable program code configured to verify the authorization code; and computer readable program code configured to execute charging for the requested content.

An additional aspect of the invention provides a computer program product comprising: a computer readable storage medium having computer readable program code embodied therewith, the computer readable program code comprising: computer readable program code configured to receive notice of a customer request for content of a third party content provider; computer readable program code configured to generate an authorization code on behalf of the content provider and returning the authorization code to the customer via a channel other than a channel which links the customer with the third party content provider; computer readable program code configured to accept the authorization code from the third party content provider as received by the third party content provider from the customer; computer readable program code configured to verify the authorization code; and computer readable program code configured to execute charging for the requested content.

BRIEF DESCRIPTION OF THE SEVERAL VIEWS OF THE DRAWINGS

FIG. 2 provides a table showing preferred channels for the ordering, delivery and management of off-deck content services.

DETAILED DESCRIPTION

Figure 1:
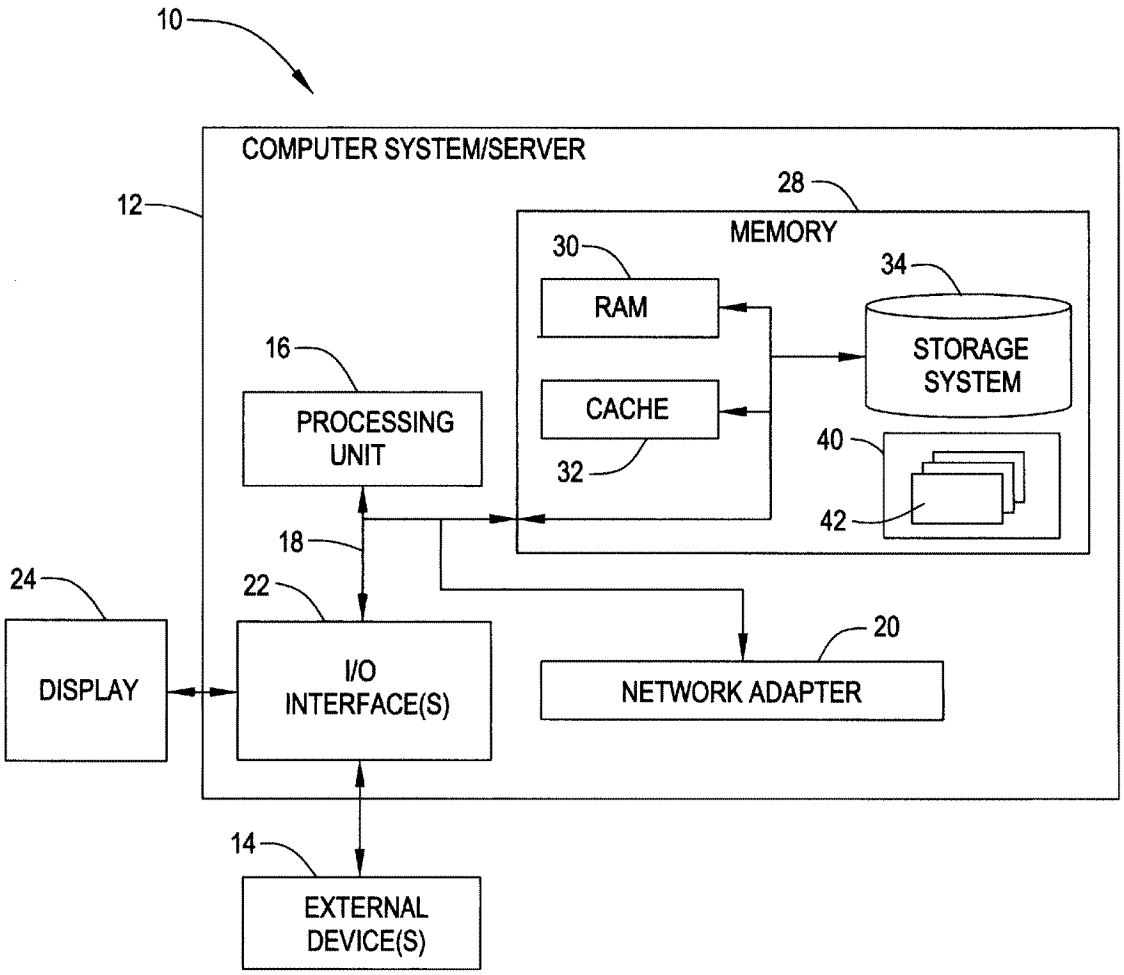
FIG. 1 illustrates a computer system.

It will be readily understood that the components of the embodiments of the invention, as generally described and illustrated in the figures herein, may be arranged and designed in a wide variety of different configurations in addition to the described exemplary embodiments. Thus, the following more detailed description of the embodiments of the invention, as represented in the figures, is not intended to limit the scope of the embodiments of the invention, as claimed, but is merely representative of exemplary embodiments of the invention.

Reference throughout this specification to "one embodiment" or "an embodiment" (or the like) means that a particular feature, structure, or characteristic described in connection with the embodiment is included in at least one embodiment of the invention. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in at least one embodiment. In the following description, numerous specific details are provided to give a thorough understanding of embodiments of the invention. One skilled in the relevant art will recognize, however, that the various embodiments of the invention can be practiced without at least one of the specific details, or with other methods, components, materials, et cetera. In other instances, well-known structures, materials, or operations are not shown or described in detail to avoid obscuring aspects of the invention.

The description now turns to the figures. The illustrated embodiments of the invention will be best understood by reference to the figures. The following description is intended only by way of example and simply illustrates certain selected exemplary embodiments of the invention as claimed herein.

It should be noted that the flowchart and block diagrams in the figures illustrate the architecture, functionality, and operation of possible implementations of systems, apparatuses, methods and computer program products according to various embodiments of the invention. In this regard, each block in the flowchart or block diagrams may represent a module, segment, or portion of code, which comprises at least one executable instruction for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove. In accordance with embodiments of the invention, computing node 10 may not necessarily even be part of a cloud network but instead could be part of another type of distributed or other network, or could represent a stand-alone node. For the purposes of discussion and illustration, however, node 10 is variously referred to herein as a "cloud computing node".

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, at least one processor or processing unit 16, a system memory 28, and a bus 18 that couples various system components including system memory 28 to processor 16.

Bus 18 represents at least one of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by at least one data media interface. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, at least one application program, other program modules, and program data. Each of the operating system, at least one application program, other program modules, and program data or some combination thereof, may include an implementation of a networking environment. Program modules 42 generally carry out the functions and/or methodologies of embodiments of the invention as described herein.

Computer system/server 12 may also communicate with at least one external device 14 such as a keyboard, a pointing device, a display 24, etc.; at least one device that enable a user to interact with computer system/server 12; and/or any devices (e.g., network card, modem, etc.) that enable computer system/server 12 to communicate with at least one other computing device. Such communication can occur via I/O interfaces 22. Still yet, computer system/server 12 can communicate with at least one network such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

The disclosure now turns to FIGS. 2-13. It should be appreciated that the processes, arrangements and products broadly illustrated therein can be carried out on or in accordance with essentially any suitable computer system or set of computer systems, which may, by way of an illustrative and non-restrictive example, include a system or server such as that indicated at 12 in FIG. 1. In accordance with an example embodiment, most if not all of the process steps, components and outputs discussed with respect to FIGS. 2-13 can be performed or utilized by way of a processing unit or units and system memory such as those indicated, respectively, at 16 and 28 in FIG. 1, whether on a server computer, a client computer, a node computer in a distributed network, or any combination thereof.

Figure 10:
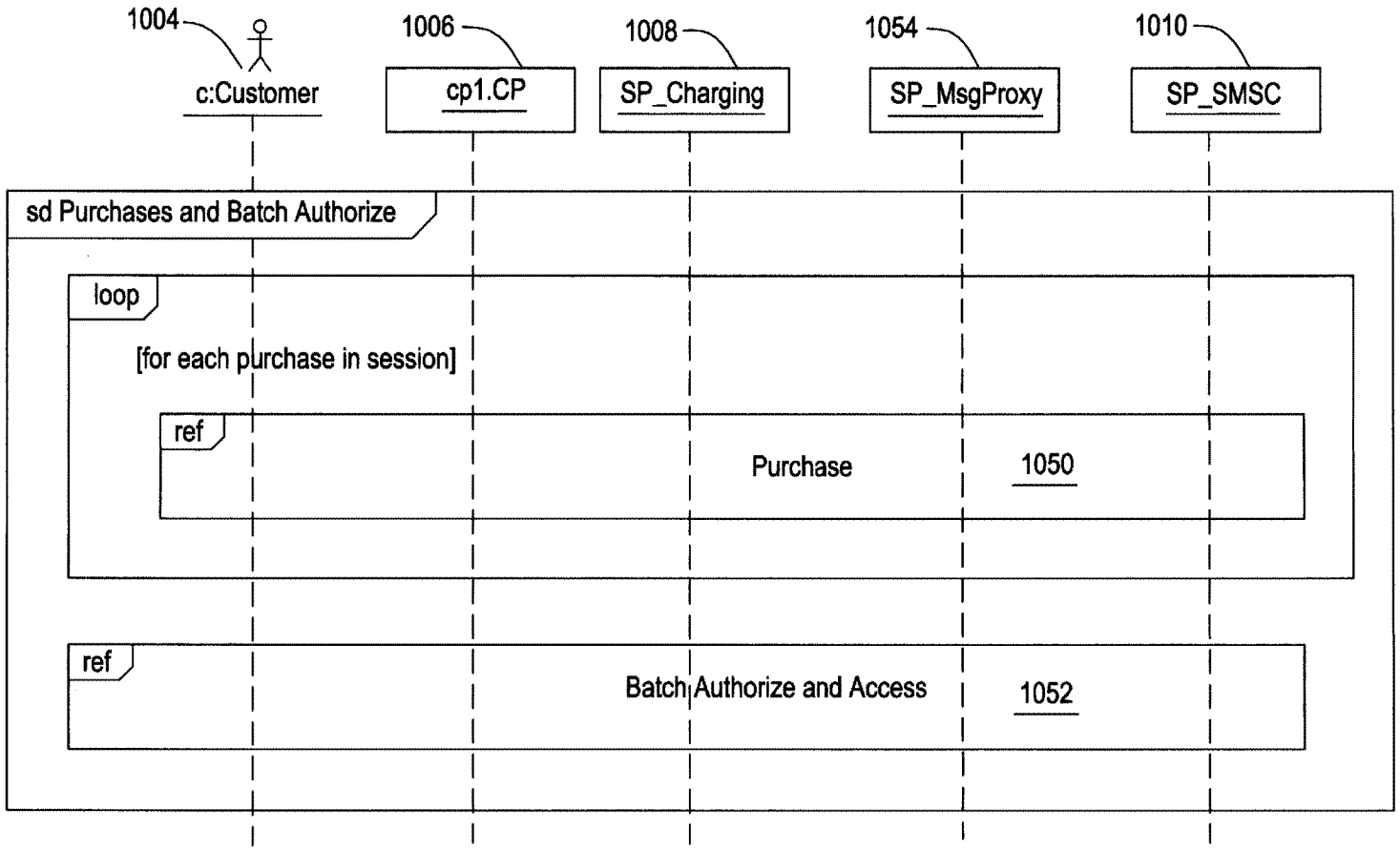
FIG. 10 schematically illustrates an arrangement, in accordance with at least one embodiment of the invention, which employs multiple purchase interactions followed by a batch authorization, in mobile content purchasing and access from a third party content provider.
Figure 11:
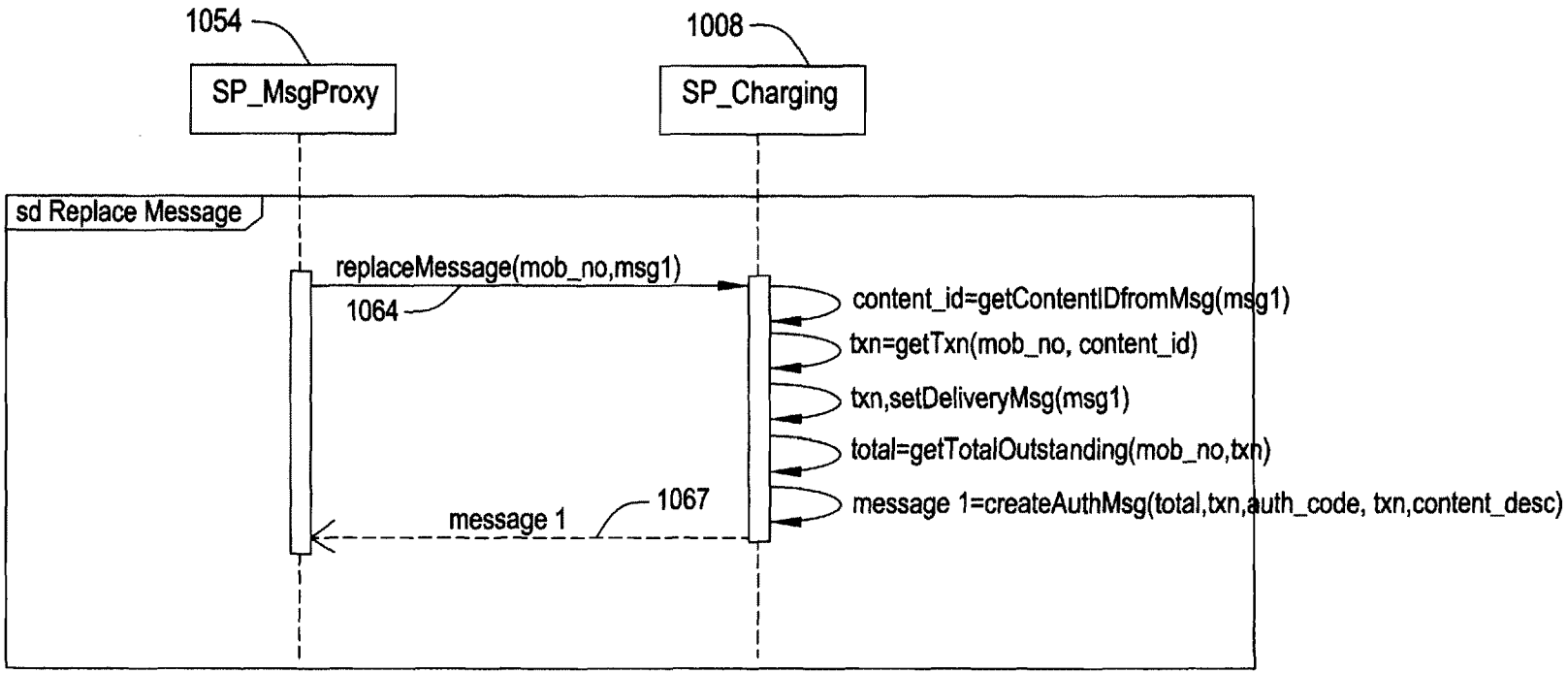
FIG. 11 schematically illustrates an arrangement, in accordance with at least one embodiment of the invention, for message replacement in mobile content purchasing and access from a third party content provider, where batch authorization is employed.
Figure 12:
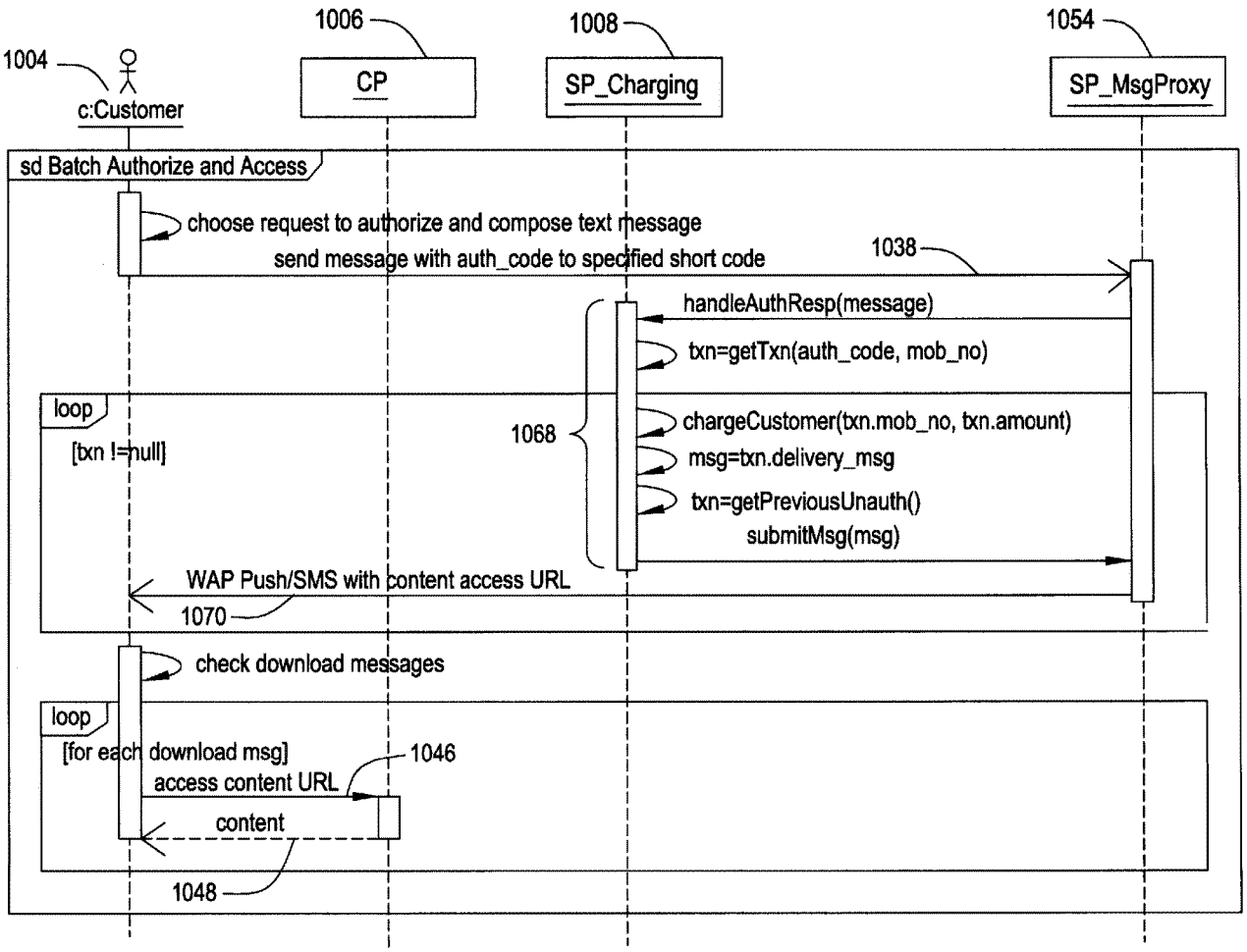
FIG. 12 schematically illustrates a arrangement, in accordance with at least one embodiment of the invention, for handling an authorization response in mobile content purchasing and access from a third party content provider, where batch authorization is employed.

To facilitate easier reference, in advancing from FIG. 2 to and through FIG. 12, a reference numeral is advanced by a multiple of 100 in indicating a substantially similar or analogous component or element with respect to at least one component or element found in at least one earlier figure among FIGS. 2-12.

In accordance with at least one embodiment of the invention, there is broadly contemplated herein a method and framework for the authorization of charging requests made by a service provider's content partners for services that were provided to its customers.

Broadly contemplated herein, in accordance with at least one embodiment of the invention, is the use of a mobile channel to facilitate and simplify authentication and authorization so that no redirection to the service provider site is required. An authorization code is sent to a customer through an SMS (short message service) channel by way of authenticating a customer as well as obtaining authorization for a specific transaction. Authorization process flow is decoupled from ordering process flow so that users can authorize asynchronously, thus improving usability over conventional arrangements. A service provider is able to control delivery of third party content so that the user authorization can be obtained before charging and content delivery. The aforementioned decoupling and delivery control is transparent to the content provider, and multiple transactions can be associated with a single authorization request to achieve batch authorization of transactions, thus further improving usability.

In the context of at least one embodiment of the invention, FIG. 2 provides a table 202 showing preferred channels for the ordering, delivery and management of off-deck content services, as generally known and understood. ("RBT" refers to ringback tone.) Channels marked with a "Y" indicate possible channels for given content/transaction types, while those shaded in grey are understood to be preferred ones. The transaction type "event" corresponds to a point purchase of an individual content item, as opposed to a subscription for a product.

As illustrated in FIG. 2, it can generally be understood that a more "natural" way to order rich content is through web or WAP (wireless application protocol), while the most popular channels for purchasing content subscriptions are SMS and web. Further, the preferred delivery mechanism for rich content is WAP push delivered over SMS. Though rich content can still be delivered over MMS (multimedia messaging service), it is generally understood that few service providers allow content partners to connect to their MMSC (MMS channel). Generally, the SMS channel is understood as being a simpler manner of managing a third party subscription (e.g., primarily for deactivation), since no authentication is generally required.

Based on this, in accordance with at least one embodiment of the invention, the following use cases are considered by way of illustration: subscription purchases (web), content purchases (web/WAP), subscription purchases (SMS) and subscription deactivation (SMS). Of course, these merely represent examples of possible use cases in accordance with at least one embodiment of the invention and are intended to be illustrative and non-restrictive.

Figure 3:
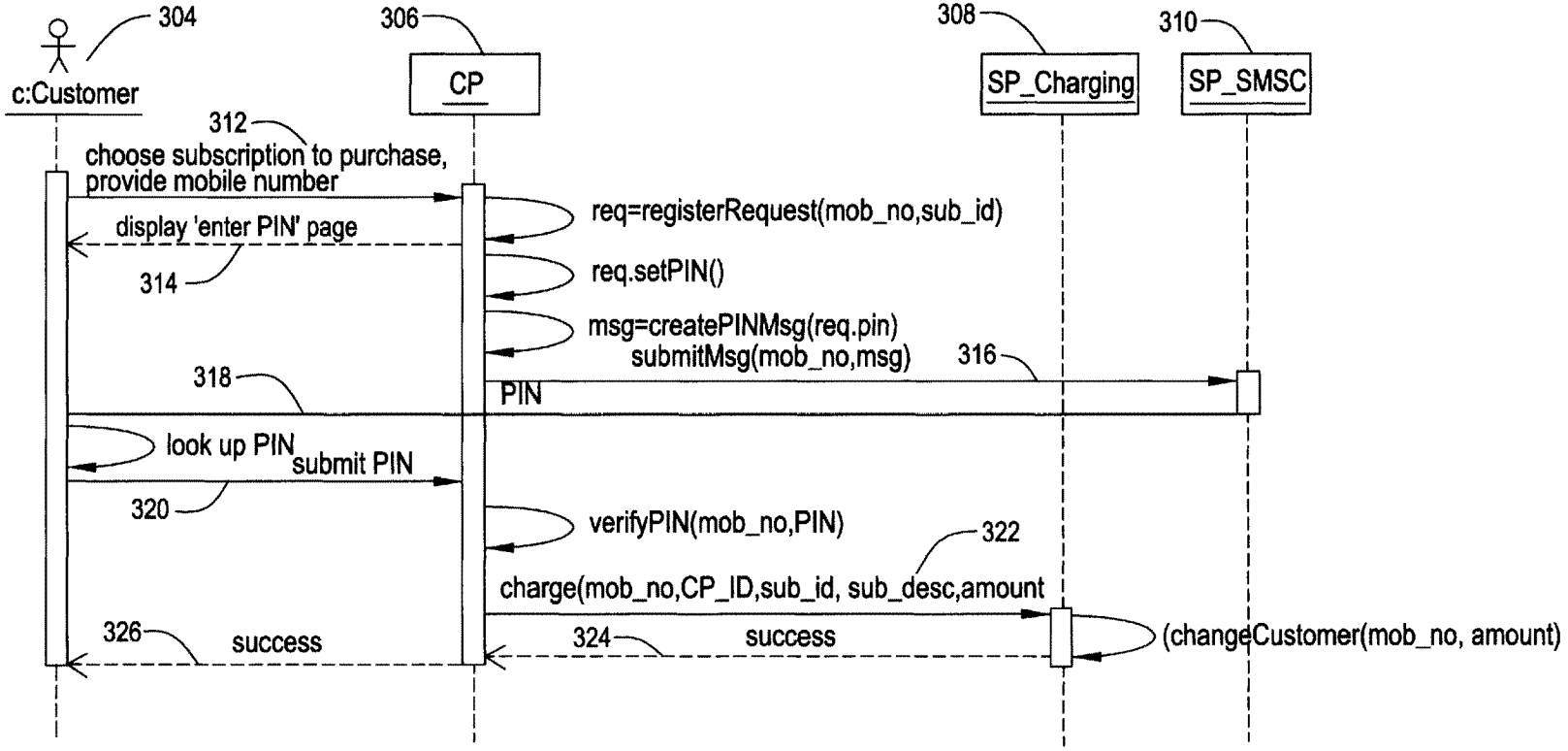
FIG. 3 schematically illustrates a conventional arrangement for mobile subscription purchasing from a third party content provider.
Figure 4:
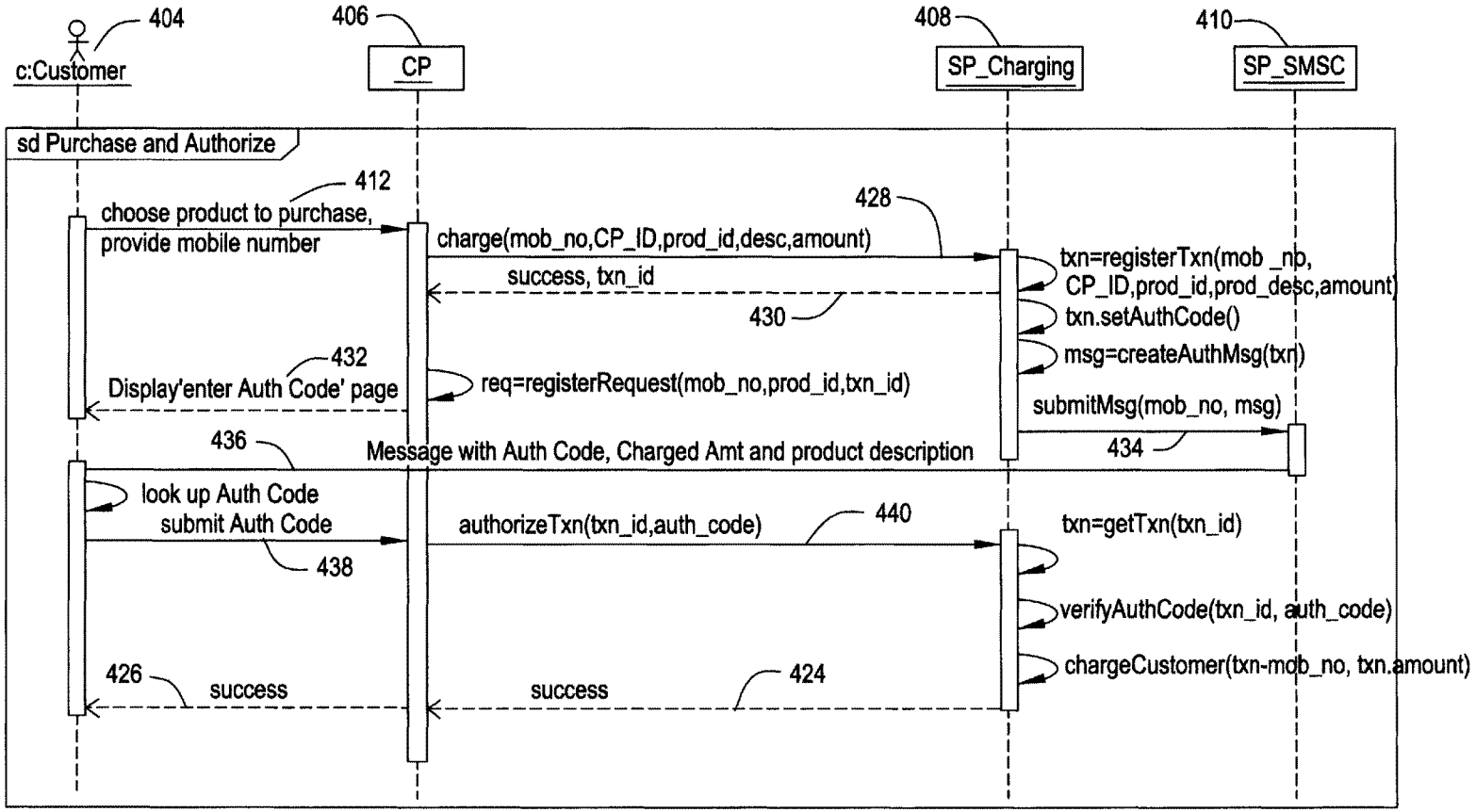
FIG. 4 schematically illustrates an arrangement, in accordance with at least one embodiment of the invention, for mobile subscription purchasing from a third party content provider.

FIGS. 3 and 4 relate to the aforementioned use case of subscription purchases over the web. Whereas FIG. 3 illustrates a conventional arrangement, FIG. 4 illustrates an arrangement in accordance with at least one embodiment of the invention. Among FIGS. 3 and 4, as well as among the FIGS. 5-12 to follow, several intermediate steps are indicated by small loop arrows. They are labeled in each case by a non-restrictive example of a command function or message undertaken in accordance with a step, and it should be understood that these are provided merely by way of illustration.

Essentially, FIG. 3 conveys the nature of interactions between various parties in a CP purchase process, which parties include the customer 304, CP 306, and service provider (SP). The service provider is shown here as including a charging arrangement or protocol 308 and a SMSC (SMS channel) 310. First, the customer 304 browses to the CP website and selects a subscription to purchase (312). While making this request, customer is prompted to provide his/her mobile number. The CP 306 then registers the request, creates a random PIN (personal identification number) and sends the same to the mobile number provided by customer for confirmation. For this, the CP 306 uses the text messaging service provided by the service provider (SP SMSC 310), thus communicating first with SP SMSC 310 (316), which thereupon sends the PIN to customer 302 (318). In the process, the customer is directed to a page requesting the PIN (314).

Next, in the conventional process illustrated in FIG. 3, the customer 304 checks his/her SMS and enters and submits the received PIN (320), which goes to CP 306. The CP 306 then verifies the PIN and sends (322) a charging request along with the mobile number, amount, and other information to the service provider (at 308). The service provider charges the requested amount to the customer's account and returns a "success" message or similar indicator to CP 306 (314). Upon receiving the "success" from the service provider (324), the CP 306 activates the subscription and confirms the purchase to the customer (326).

In contrast, in a process according to at least one embodiment of the invention as shown in FIG. 4, the following steps are undertaken. First, the customer 404 browses to the CP website and selects a subscription to purchase (412). While making the request for purchase, the customer is asked to provide his/her mobile number. Next, the CP 406 sends (428) a charging request, with the mobile number, amount and other information, to the service provider (at 408). The service provider registers the transaction and returns (430) a transaction ID to the CP 406 indicating that the request has been registered, but not charged. Thence, the CP 406 displays (432) to customer 404 a page for entering an authorization code is to be provided to customer 404 by the service provider.

Continuing with the process of FIG. 4, in accordance with at least one embodiment of the invention, the service provider associates an authorization code with the transaction, then sends (334/336) a message to the customer 404 (via SMSC 410) with the authorization code, product description and amount to be charged. The message instructs the customer 404 to enter the authorization code at the CP website if the content details and charged amount are correct. Accordingly, once the customer 404 is able to make such a verification, he/she enters the authorization code (438) at the CP web site.

Thereafter, in the process of FIG. 4 in accordance with at least one embodiment of the invention, the CP 406 sends (440) the authorization code along with a transaction ID to the service provider (at 408) as proof of authorization. (The transaction ID can essentially be any type of numeric or alphanumeric label that is applied to the transaction.) The service provider verifies the authorization code, charges the customer 404 and returns "success" (424) to the CP 406, while upon receiving "success," the CP 406 completes the transaction and conveys (426) successful completion of the transaction to the customer 404.

The approach described hereinabove with respect to FIG. 4 does not require any change in user behavior. The authorization code sent by the service provider functions similarly to the PIN sent by a CP in a conventional approach such as that shown in FIG. 3. However, in a process according to at least one embodiment of the invention as shown in FIG. 4, the same code is used to authenticate (i.e. verify a claim that the mobile number asserted by web user is correct) as well as to authorize the charge request.

Figure 5:
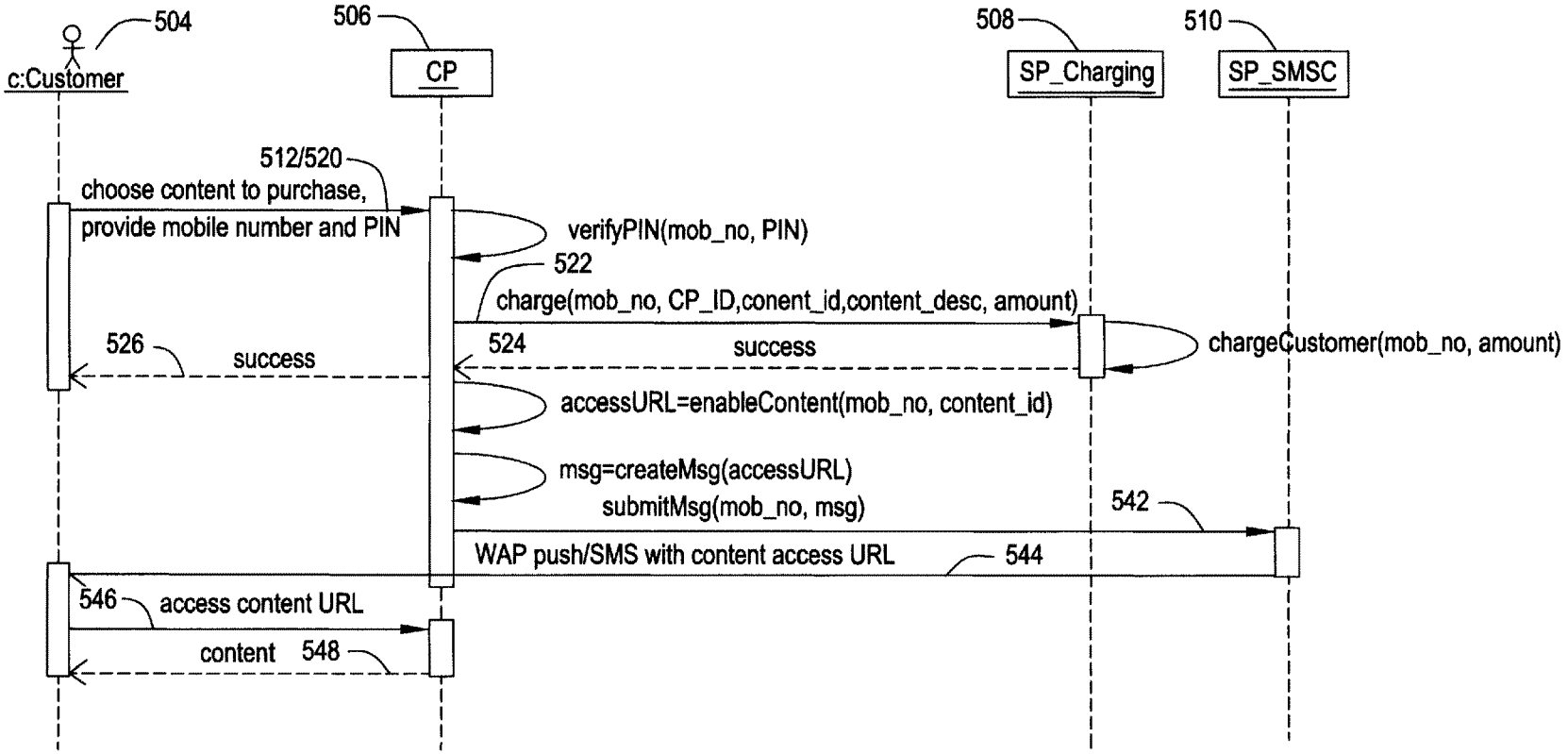
FIG. 5 schematically illustrates a conventional arrangement for mobile content purchasing and access from a third party content provider.

FIGS. 5-12 relate to the aforementioned use case of purchasing content through the web or WAP. Whereas FIG. 5 illustrates a conventional arrangement, FIGS. 6-9 illustrate aspects of arrangements in accordance with at least one embodiment of the invention. FIGS. 6-9, in particular, involve asynchronous authorization while FIGS. 10-12 relate to batch authorizations.

Generally, it can be understood that purchasing a content item is similar to purchasing a subscription. However, in the former case (now to be addressed), content is usually delivered through a URL embedded in a WAP push message sent to the customer. Thus, in accordance with the conventional arrangement shown in FIG. 5, several initial steps are similar to those set for in FIG. 3; some extraneous steps are not shown in FIG. 5. Essentially, the customer 504 submits a mobile number and a PIN (512/520) and the CP 506 communicates (522) with the SP (at 508) with a charge authorization and other information. Major differences then involve, upon receiving a "success" (524) from the service provider and relaying (526) the same to customer 502, the CP 506 then making content available at a URL and sending the URL to the customer 504 via an SMS or WAP push (steps 524 and 544, relayed via the SP at 510). The customer 504 then opens the WAP push message or clicks the content URL (546) and is able to download the content from CP 506 (548).

Turning now to an approach in accordance with at least one embodiment of the invention, as shown in FIGS. 6-9, it can first be appreciated that the approach of FIG. 4 (described hereinabove) provides essentially a generic arrangement for authorizing any type of third party purchase performed by subscribers of a mobile service provider over the web channel. However, it may be awkward to carry out on WAP channel since that would involve switching from browser to the messaging application to check the authorization code sent by the service provider. Most mobile devices have a single threaded OS which makes it infeasible to seamlessly continue with the purchase at the CP website after switching to the messaging application.

Thus, in accordance with at least one embodiment of the invention, inasmuch as WAP is recognized as a preferred channel for browsing and purchasing individual third party content items, the problem of switching to messaging application for retrieving the authorization code could be avoided if the authorization step could be moved out of the ordering process and executed separately at a later point of time.

Figure 6:
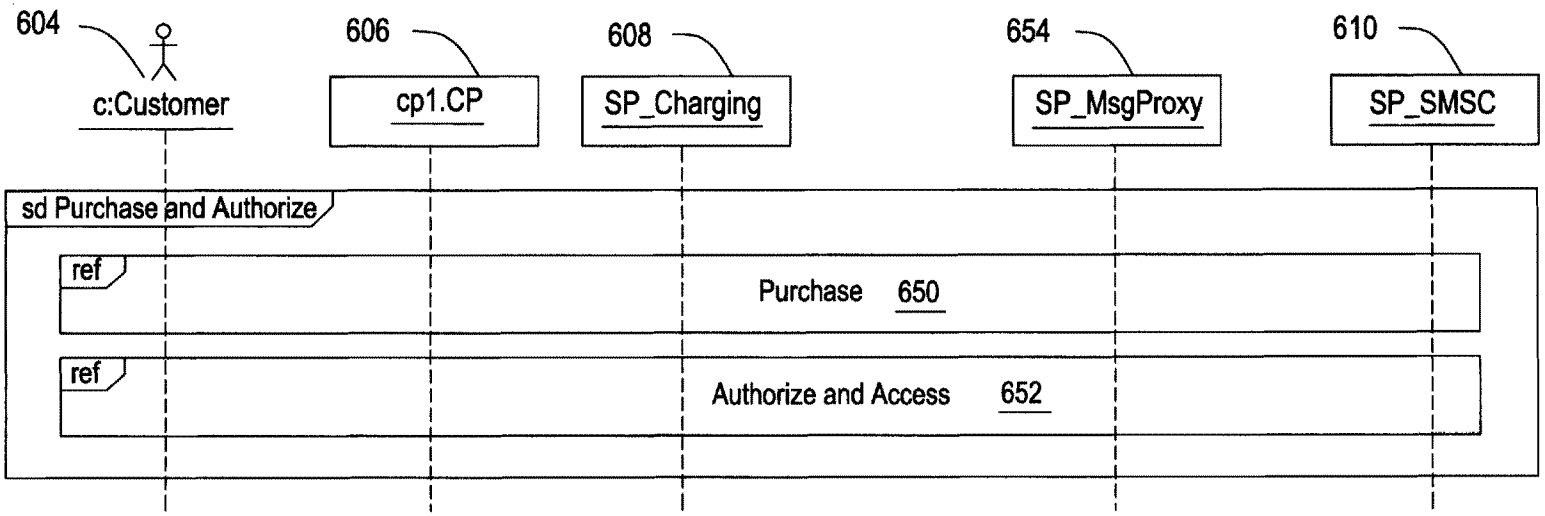
FIG. 6 schematically illustrates an arrangement, in accordance with at least one embodiment of the invention, which decouples ordering and authorization in mobile content purchasing and access from a third party content provider, where asynchronous authorization is employed.
Figure 7:
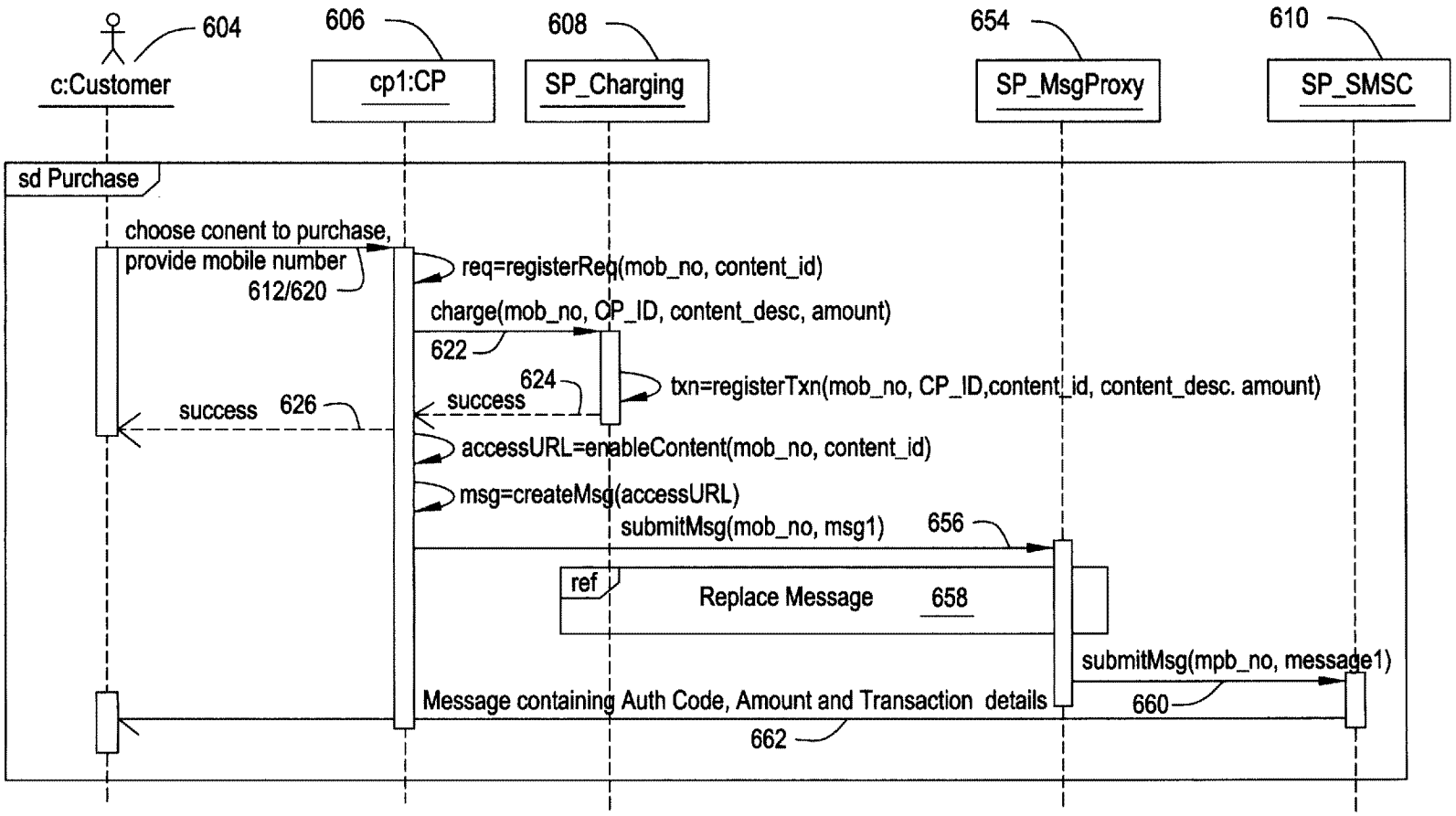
FIG. 7 schematically illustrates an arrangement, in accordance with at least one embodiment of the invention, for ordering content in mobile content purchasing and access from a third party content provider, where asynchronous authorization is employed.

Accordingly, in accordance with at least one embodiment of the invention, FIG. 6 broadly illustrates that the purchase (ordering) 650 and authorization process 652 are separated and essentially segregated, while FIG. 7 shows the actual purchase interaction. With continued reference to FIGS. 6 and 7, and in comparison with the conventional approach of FIG. 5, there are two major changes at the service provider. First, the service provider does not charge the customer immediately after receiving the charging request from the CP. Instead, it only records the request parameters for future use. Second, when the CP sends the download link for the content through an SMS/WAP push to the user, the message containing it is intercepted by a messaging proxy 654 and stored by the service provider. The message is replaced (658) by a request to the user for authorizing the transaction by returning an included authorization code through a text message (660/662, as relayed by SMSC 610).

Figure 8:
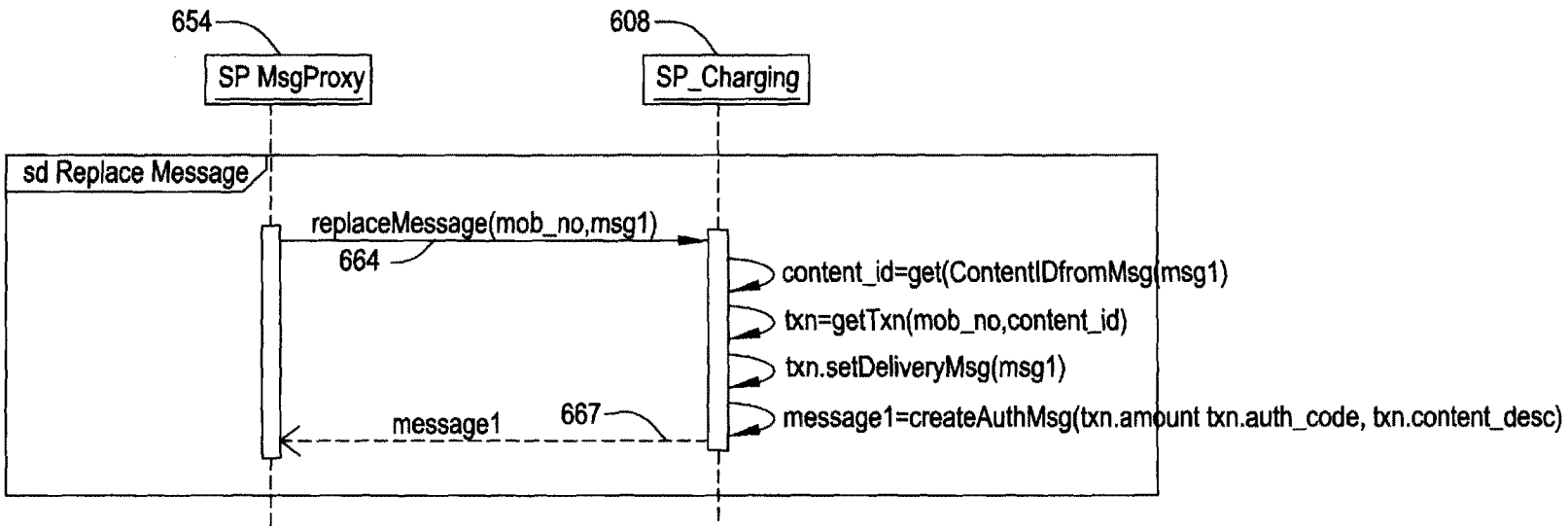
FIG. 8 schematically illustrates an arrangement, in accordance with at least one embodiment of the invention, for message replacement in mobile content purchasing and access from a third party content provider, where asynchronous authorization is employed.

The details of message replacement are shown in FIG. 8, in accordance with at least one embodiment of the invention. In particular, a content identifier in the intercepted message (656 in FIG. 7) and the destination mobile number are used by proxy 654 to look up (664) the transaction which was stored earlier (622 in FIG. 7) at charging module 608. A new message is constructed, and then sent (667) to proxy 654, to then be relayed onward (660 in FIG. 7) to the customer, advising the customer of the charge corresponding to the purchased content and requesting for confirmation. This replaces the original SMS/WAP push with a link to the content. The original message (656 in FIG. 7) remains stored at proxy 654 as an additional detail of the transaction for later use.

Figure 9:
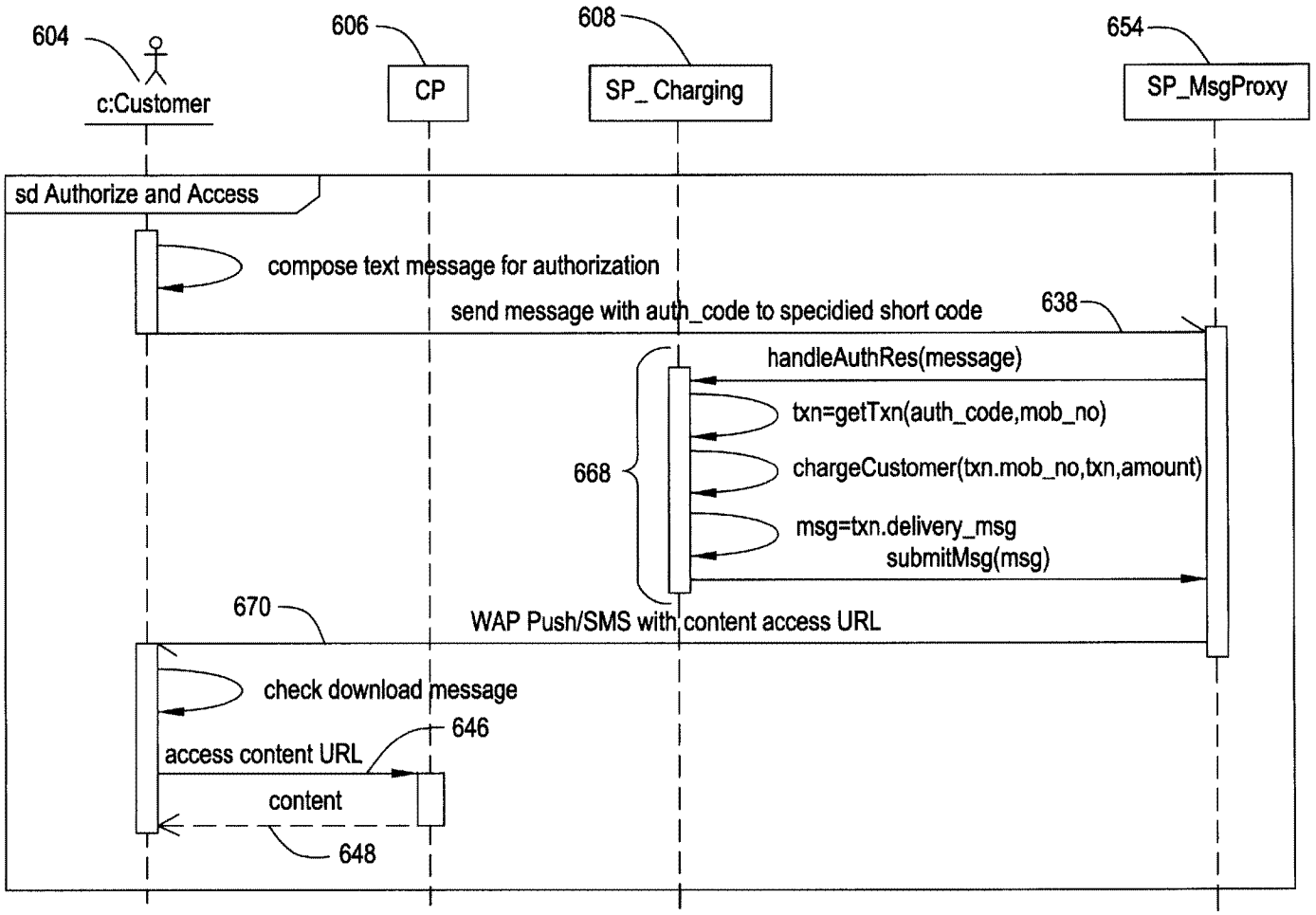
FIG. 9 schematically illustrates a arrangement, in accordance with at least one embodiment of the invention, for handling an authorization response in mobile content purchasing and access from a third party content provider, where asynchronous authorization is employed.

FIG. 9 illustrates, in accordance with at least one embodiment of the invention, the authorization flow in the asynchronous authorization arrangement of FIGS. 6-8, and essentially continues from where the process in FIG. 7 leaves off. Particularly, the customer sends back the authorization code (638) and, in response, the service provider, with the messaging proxy 654 communicating with the charging module 608, retrieves the transaction and charges the user for the transaction (668). If the charging is successful, the service provider charging module 608 retrieves the original message (stored at proxy 654) with download link originally sent by the CP 606, and forwards (670) the message to the customer 604. The user can then click on the URL (646) to access the content (648).

Notably, the approach of FIGS. 6-9 is transparent to the CP 606. This can be seen in the similarity between FIGS. 5 and FIG. 7, with respect to interactions with the CP. In particular, the CP 606 in FIG. 7 is not involved in the authorization flow between service provider (608/610/654) and the customer 604. It assumes that the service provider will charge the customer 604 before providing him/her the download URL. The CP 606 then only claims revenue from the service provider if the download URL was actually accessed by the customer 604.

FIGS. 10-12 relate to a variant approach, in accordance with at least one embodiment of the invention, where batch authorizations are involved. Here, multiple executions of purchase interactions 1050 (with at least one content partner) are followed by a single execution of the authorization and access flow 1052, as shown in FIG. 10. A key difference with respect to the approach of FIGS. 6-9 is that the authorization requested from the customer 1004 not only corresponds to the last transaction, but also to all previous unauthorized transactions. Accordingly, a modified logic for replacing the message sent by the content provider is shown in FIG. 11.

As such, in accordance with at least one embodiment of the invention as contemplated broadly in accordance with FIGS. 10-12, the customer 1004 is not required to authorize each transaction. The batch authorization process itself is shown in FIG. 12. At the end of a customer session, the customer may choose to perform a batch authorization for all transactions in the session by sending the authorization code received in the last authorization message (1038). Once the user performs the authorization requested in the last message, the service provider (via employing a messaging proxy 1054) authorizes all transactions in the session and undertakes the (monetary) charging (1068), and then forwards download messages (originally received from CP 1006) one by one to the user (1070). The user then opens these messages (1046) to download the content (1048). The actions in FIG. 11 are essentially similar to those described and illustrated with respect to FIG. 8, except that the advising of the customer of the charge relates to total outstanding unapproved charges, as opposed to the charge of a current transaction.

Essentially, the approach of FIGS. 6-9 relates (by way of illustrative and non-restrictive example) to ordering through web channel, while the approach of FIGS. 10-12 relates (by way of illustrative and non-restrictive examples) to ordering through web and WAP channels. However, the aforementioned use cases of ordering off-deck content (e.g., individual items and subscriptions) through an SMS channel will also now be explored in illustrative and non-restrictive fashion.

Conventionally, a typical workflow for ordering off-deck content through SMS involves the customer sending a text message with a key word (to a specified short code) to request a content item or to avail a subscription offer, while a messaging proxy at the service provider routes the request to the content partner responsible for the service. The CP makes a charging request corresponding to the content purchase. The service provider then charges the customer and returns "success" to the CP, while thereupon the CP makes the content available and sends a WAP push/SMS, with a link to the content, to the customer. Then the customer may click on the message/URL to access the content.

In accordance with at least one variant embodiment of the invention, the approach described and illustrated hereinabove with respect to FIGS. 6-9 can be modified to permit ordering via SMS. This can be accomplished by removing the first message in FIG. 7 (step 612) and adding interactions corresponding to the aforementioned steps of: sending a text message with a key word (to a specified short code) to request a content item or to avail a subscription offer; with the messaging proxy at the service provider routing the request to the content partner responsible for the service.

In accordance with at least one other variant embodiment in accordance with the invention, it is possible to include the authorization information as part of the aforementioned step of sending a text message with a key word (to a specified short code) to request a content item or to avail a subscription offer. This has the effect of further reducing the number of exchanges. Thus, by way of an illustrative and non-restrictive example, if the normal message for requesting a wall paper from a service provider is:

SMS to 58888: WALL <code> then, the authorization information can be included as illustrated in the two messages below:

SMS to 58888: WALL 123 AUTH 5//Limit charge for wall paper (ID=123) to Rs. 5; and SMS to 58888: WALL 23 AUTH @30 pm//Limit charge for wall paper subscription (ID=23) to Rs. 30 per month;

wherein Rs=rupees (currency of India).

Accordingly, the service provider can then easily handle a message containing authorization as follows. First, the request is parsed for authorization parameters and key word. The service provider registers the request (for a given short code, key word) against the customer. The request (along with key word) is then routed to the CP. Thence, the charging request from the CP is compared with the registered request and permitted only if the charged amount is within limits authorized by the customer.

There is further broadly contemplated, in accordance with at least one variant embodiment of the invention, an arrangement for pre-authorization. Essentially, in the approaches contemplated hereinabove in connection with FIGS. 6-12, the user sends an authorization code to authorize either a single transaction (asynchronous, FIGS. 6-9) or a set of transactions (batch, FIGS. 10-12). In both cases, authorization follows at least one purchase transaction. However, in some cases, a customer may trust a specific content partner and would wish to preauthorize transactions for the CP, while continuing to require authorizations for other content partners. Non-restrictive examples of pre-authorization requests can include (but by no means are not limited to): requesting that no authorization be required for charging requests made by the CP; specifying the maximum amount which can be debited/charged by the CP without requiring an authorization; and authorization for a maximum amount that can be debited/charged by the CP during the span of a fixed period (e.g. day, week, month etc).

In accordance with at least one embodiment of the invention, if the service is ordered through a web or WAP channel, the identity of the content partner (or at least its web address) is known to the customer. A service provider could provide its customers a feature on a self-care portal to pre-approve charging for at least one CP. For each request, the user could select a CP (e.g. based on web address) from a list of CP's displayed on the page and specify pre-authorization information such as maximum amount, determinative time period, etc. The customer can also be afforded the equivalent facility of getting such pre-authorization preferences registered through interactive voice response (IVR) or by directly speaking with a customer care representative.

In accordance with at least one embodiment of the invention, if the service is being ordered through an SMS channel, the customer in all probability will be unaware of the CP providing the service. In such a case, pre-authorization can be linked to the short code which is used for ordering the service. In the SMS approaches discussed hereinabove with respect to FIGS. 6-12, the authorization step involves sending an authorization code to a specified short code, this code either being associated with a single transaction (asynchronous authorization, FIGS. 6-9) or multiple transactions (batch authorizations, FIGS. 10-12). For pre-authorization, a short code normally used for ordering a service from the provider can be used instead of the authorization code. Illustrative and non-restrictive example messages for pre-authorizing a CP that offers services through short code 58888 are shown below. The messages are sent to the service provider charging service (assumed to be configured at short code 55555):

SMS 55555, text: 58888 AUTH//No authorization required for CP.

SMS 55555, text: 58888 AUTH 50//CP pre-authorized for Rs 50.)

SMS 55555, text: 58888 AUTH @50 pm//CP pre-authorized for Rs 50 per month.

Support for pre-authorization options as described above can be easily implemented at the provider by storing these preferences for users and keeping track of a remaining pre-authorized amount for a CP in a given time period. If a charging request from a CP is for an amount greater than remaining authorization amount for that CP, then either the charge request can be failed as unauthorized, or a post purchase authorization flow (e.g., as contemplated hereinabove with respect to FIG. 4, FIGS. 6-9 or FIGS. 10-12) can be invoked.

Figure 13:
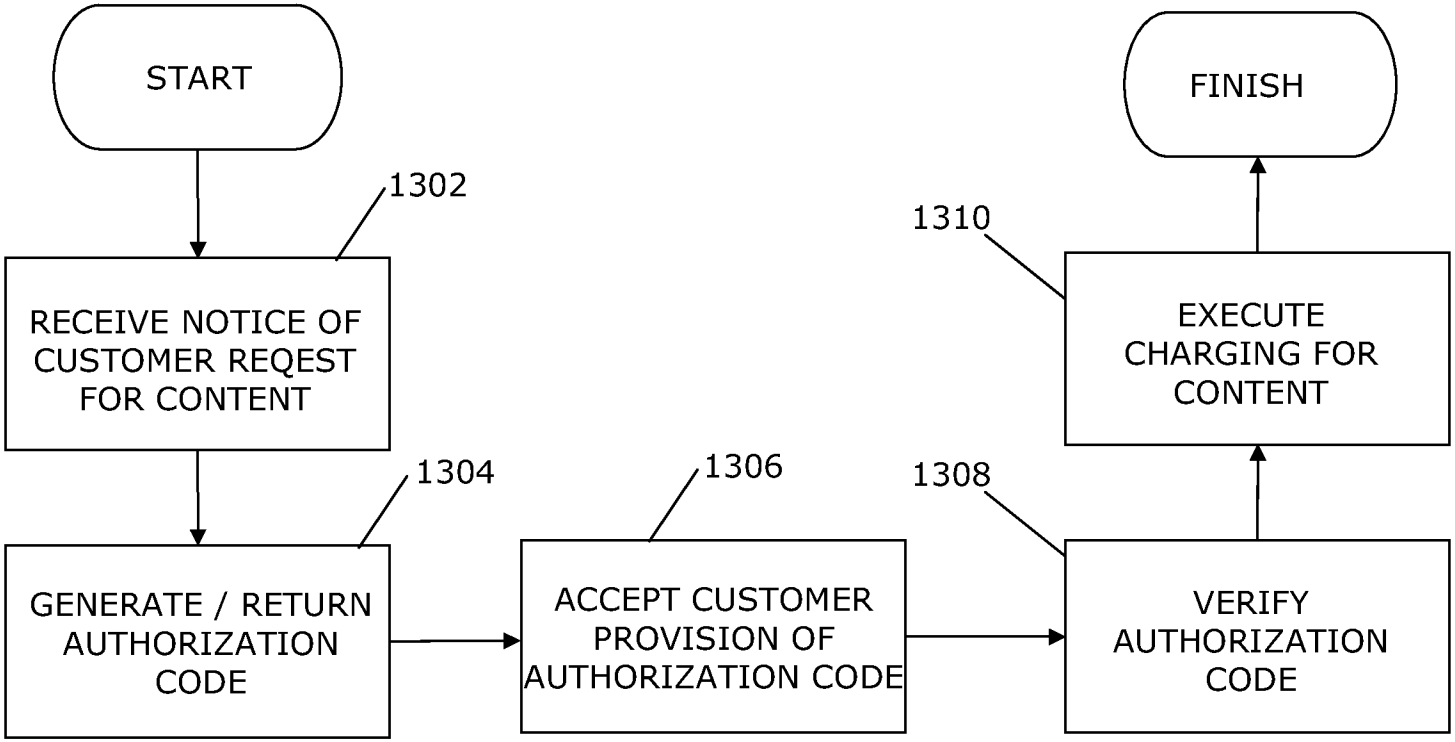
FIG. 13 sets forth a process more generally for handling web-based purchase requests, in accordance with at least one embodiment of the invention.

FIG. 13 sets forth a process more generally for handling web-based purchase requests, in accordance with at least one embodiment of the invention. It should be appreciated that a process such as that broadly illustrated in FIG. 13 can be carried out on essentially any suitable computer system or set of computer systems, which may, by way of an illustrative and on-restrictive example, include a system such as that indicated at 12 in FIG. 1. In accordance with an example embodiment, most if not all of the process steps discussed with respect to FIG. 13 can be performed by way a processing unit or units and system memory such as those indicated, respectively, at 16 and 28 in FIG. 1.

As shown in FIG. 13, notice of a customer request for content of a third party content provider is received at a charging service provider (1302). An authorization code on behalf of the content provider is generated and returned to the customer (1304), via a channel other than a channel which links the customer with the third party content provider. The authorization code is accepted from the third party content provider as received by the third party content provider from the customer (1306), the authorization code is verified (1308), and charging for the requested content is executed (1310).

It should be noted that aspects of the invention may be embodied as a system, method or computer program product. Accordingly, aspects of the invention may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the invention may take the form of a computer program product embodied in at least one computer readable medium having computer readable program code embodied thereon.

Any combination of at least one computer readable medium may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having at least one wire, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wire line, optical fiber cable, RF, etc., or any suitable combination of the foregoing.

Computer program code for carrying out operations for aspects of the invention may be written in any combination of at least one programming language, including an object oriented programming language such as Java®, Smalltalk, C++ or the like and conventional procedural programming languages, such as the "C" programming language or similar programming languages. The program code may execute entirely on the user's computer (device), partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments of the invention have been described herein with reference to the accompanying drawings, it is to be understood that the embodiments of the invention are not limited to those precise embodiments, and that various other changes and modifications may be affected therein by one skilled in the art without departing from the scope or spirit of the disclosure.

What is claimed is:

1. A method comprising:

utilizing at least one processor to execute computer code configured to perform the following steps at a charging service provider:

receiving, at the charging service provider, notice of a customer request for content of a third party content provider;

generating, at the charging service provider, an authorization code on behalf of the content provider and returning (i) the authorization code, (ii) an identification of the content to be purchased, and (iii) an amount to be charged to the customer via a channel independent of the third party content provider;

accepting, at the charging service provider, the authorization code from the third party content provider once the third party content provider receives the authorization code from the customer;

verifying, at the charging service provider, the authorization code provided by the third party content provider against the authorization code generated by the charging service provider;

executing at the charging service provider and responsive to determining that the authorization code provided by the third party content provider matches the authorization code generated by the service provider, charging for the requested content; and availing the requested content to the customer via:

receiving a communication originating from the third party content provider, the communication comprising a link which avails customer access to the requested content; and blocking customer access to the requested content until said verifying of the authorization code, via controlling access to a URL of the third party content provider, the URL comprising the link which avails customer access to the requested content;

wherein the requested content comprises content availed to the customer via a message containing the URL, the message comprising the communication originating from the third party content provider and the URL comprising the link which avails customer access to the requested content;

said blocking comprising:

holding the message at the charging service provider; and releasing the message to the customer subsequent to:

said generating and returning of the authorization code; and said verification of the authorization code.

2. The method according to claim 1, wherein:

said receiving comprises receiving notice of a customer purchase action at the third party content provider;

said returning comprises returning the authorization code along with charge information;

said accepting comprising accepting the authorization code from the third party content provider as received by the third party content provider from the customer over a channel which links the customer with the third party content provider;

said verifying comprises validating the authorization code at the charging service provider; and said method further comprises confirming the charging to the third party content provider and prompting the third party content provider to avail purchased content to the customer.

3. The method according to claim 1, wherein the content comprises at least one taken from the group consisting of: a subscription purchase; content purchase.

4. The method according to claim 1, wherein: the charging service provider comprises a mobile phone service operator, with the content provider comprising a provider of mobile phone compatible content.

5. The method according to claim 4, wherein said executing comprises charging against a mobile phone account of the customer.

6. The method according to claim 1, wherein:

said accepting comprises accepting customer provision of the authorization code as issued by the third party content provider and comprises no redirection to a website of the charging service provider for achieving authorization; and said verifying is transparent to the third party content provider.

7. The method according to claim 1, wherein said receiving and said verifying are performed asynchronously.

8. The method according to claim 1, wherein said blocking comprises intercepting the message transmitted by the third content provider to the customer, wherein the message contains the URL.

9. The method according to claim 1, wherein the predetermined authorization condition comprises:

the authorization code being generated and returned to the customer; and customer provision of the authorization code being accepted.

10. The method according to claim 1, further comprising:

at least twice performing said receiving notice of a customer request for content of at least one third party content provider;

at least twice performing said blocking of customer access to the requested content; and solely once performing said accepting customer provision of the authorization code.

11. The method according to claim 10, wherein:

the requested content comprises content availed to the customer via at least two messages containing URL's, the messages comprising the communication originating from the third party content provider and the URL's comprising the link which avails access to the requested content;

said blocking comprises holding the messages, and then releasing the messages to the customer upon a predetermined authorization condition being satisfied.

12. The method according to claim 11, wherein the predetermined authorization condition comprises:

an authorization code corresponding to each request for content being generated and returned to the customer; and customer provision of a final single authorization code being accepted.

13. The method according to claim 1, wherein:

said returning of the authorization code comprises sending a text message to the customer;

said channel independent of the third party content provider comprising a medium for sending a text message to the customer.

14. The method according to claim 1, wherein the notice of customer request comprises an SMS message.

15. The method according to claim 1, wherein, by way of preauthorization, said generating, accepting and verifying are performed prior to said receiving.

16. The method according to claim 15, wherein said accepting comprises receiving from a customer preauthorization information specifying the third party content provider.

17. The method according to claim 15, wherein said accepting comprises receiving from a customer preauthorization information appended to a code for ordering, wherein the code does not specify the third party content provider.

18. An apparatus comprising:

at least one processor; and a non-transitory computer readable storage medium having computer readable program code embodied therewith and executable by the at least one processor, the computer readable program code comprising:

at a charging service provider, computer readable code configured to:

receive, at the charging service provider, notice of a customer request for content of a third party content provider;

generate, at the charging service provider, an authorization code on behalf of the content provider and returning (i) the authorization code (ii) an identification of the content to be; purchased, and fin) an amount to be charged to the customer via a channel independent of the third party content provider accept, at the charging service provider, the authorization code from the third party content provider once the third party content provider has received the authorization code from the customer;

verify, at the charging service provider, the authorization code provided by the third party content provider against the authorization code generated by the charging service provider;

execute, at the charging service provider and responsive to determining that the authorization code provided by the third party content provider matches the authorization code generated by the service provider, charging for the requested content;

avail the requested content to the customer via:

receiving a communication originating from the third party content provider, the communication comprising a link which avails customer access to the requested content; and blocking customer access to the requested content until said verifying of the authorization code, via controlling access to a URL of the third party content provider, the URL comprising the link which avails customer access to the requested content;

wherein the requested content comprises content availed to the customer via a message containing the URL, the message comprising the communication originating from the third party content provider and the URL comprising the link which avails customer access to the requested content;

said blocking comprising:

holding the message at the charging service provider; and releasing the message to the customer subsequent to:

said generating and returning of the authorization code; and said verification of the authorization code.

19. A computer program product embodied within a non-transitory computer readable storage medium having computer readable program code embodied therewith and executable by at least one processor, the computer readable program code comprising:

at a charging service provider, computer readable code configured to:

receive, at the charging service provider, notice of a customer request for content of a third party content provider;

generate, at the charging service provider, an authorization code on behalf of the content provider and returning (i) the authorization code, (ii) an identification of the content to be purchased, and (iii) an amount to be charged to the customer via a channel independent of the third party content provider;

accept, at the charging service provider, the authorization code from the third party content provider once the third party content provider has received the authorization code from the customer;

verify, at the charging service provider, the authorization code provided by the third party content provider against the authorization code generated by the service provider;

execute, at the charging service provider and responsive to determined that the authorization code provided by the third party content provider matches the authorization code generated by the service provider, charging for the requested content;

avail the requested content to the customer via:

receiving a communication originating from the third party content provider, the communication comprising a link which avails customer access to the requested content; and blocking customer access to the requested content until said verifying of the authorization code, via controlling access to a URL of the third party content provider, the URL comprising the link which avails customer access to the requested content;

wherein the requested content comprises content availed to the customer via a message containing the URL, the message comprising the communication originating from the third party content provider and the URL comprising the link which avails customer access to the requested content;

said blocking comprising:

holding the message at the charging service provider; and releasing the message to the customer subsequent to:

said generating and returning of the authorization code; and said verification of the authorization code.

20. The computer program product according to claim 19, wherein:

said computer readable program code is configured to receive notice of a customer purchase action at the third party content provider;

said computer readable program code is configured to return the authorization code along with charge information;

said computer readable program code is further configured to accept the authorization code from the third party content provider as received by the third party content provider from the customer over a channel which links the customer with the third party content provider;

said computer readable program code is configured to validate the authorization code at the charging service provider; and said computer readable program code is further configured to confirm the charging to the third party content provider and prompt the third party content provider to avail purchased content to the customer.

21. The computer program product according to claim 19, wherein said computer readable program code is configured to perform the receiving and verifying asynchronously.

22. The computer program product according to claim 19, wherein:

said computer readable program code is configured to at least twice receive notice of a customer request for content of at least one third party content provider;

said computer readable program code is configured to at least twice block customer access to the requested content; and said computer readable program code is configured to solely once accept customer provision of the authorization code.

* * * * *